US007954284B2

(12) United States Patent
Rosskamp et al.

(10) Patent No.: US 7,954,284 B2
(45) Date of Patent: Jun. 7, 2011

(54) RETAINER CLIP FOR GRID SIMULATING MUNTINS

(75) Inventors: Barent A. Rosskamp, Butler, PA (US); Michael Buchanan, Cranberry Township, PA (US); Stephen L. Crandell, Cranberry Township, PA (US); William B. Davis, II, Fombell, PA (US); Cory D. Steffek, Evanston, IL (US)

(73) Assignee: PPG Industries Ohio, Inc., Cleveland, OH (US)

( * ) Notice: Subject to any disclaimer, the term of this patent is extended or adjusted under 35 U.S.C. 154(b) by 134 days.

(21) Appl. No.: 11/847,574

(22) Filed: Aug. 30, 2007

(65) Prior Publication Data

US 2009/0056264 A1 Mar. 5, 2009

(51) Int. Cl.
*E06B 3/964* (2006.01)

(52) U.S. Cl. ..... 52/204.61; 52/456; 52/786.13; 52/204.53

(58) Field of Classification Search ..... 52/204.61, 52/456, 786.13, 660–664, 204.53, 204.57, 52/204.595, 204.67, 204.71, 204.72; 428/34; 403/297, 298; 24/297, 458
See application file for complete search history.

(56) References Cited

U.S. PATENT DOCUMENTS 3,130,822 A * 4/1964 Meyer ..... 24/297
3,760,544 A * 9/1973 Hawes et al. ..... 52/468
4,067,155 A * 1/1978 Ruff et al. ..... 52/105
4,170,460 A 10/1979 Donley
4,239,816 A 12/1980 Breininger et al.
4,462,884 A 7/1984 Gillery et al.
4,556,337 A * 12/1985 Marshall ..... 403/255
4,610,711 A 9/1986 Matesa et al.
4,635,326 A * 1/1987 Yagi ..... 24/453
4,692,389 A 9/1987 Gillery et al.
4,719,127 A 1/1988 Greenberg (Continued)

FOREIGN PATENT DOCUMENTS

EP 1 522 668 A2 4/2005

OTHER PUBLICATIONS

PCT International Search Report and Written Opinion of the International Searching Authority dated Mar. 9, 2009 for International Application No. PCT/US2008/074378 filed Aug. 27, 2008.

(Continued)

*Primary Examiner* — Basil Katcheves
*Assistant Examiner* — Theodore Adamos
(74) *Attorney, Agent, or Firm* — Andrew C. Siminerio

(57) ABSTRACT

A grid simulating muntins is retained or secured by clips within a spacer frame between glass sheets. The clips include a spacer-engaging member having a platform, and upright walls bendable toward one another, and a grid-engaging member. The grid-engaging member is mounted on the platform, extends upward between and spaced from the upright walls, and is received into one of the ends of the elongated members of the grid. The platform and portions of the upright walls of the spacer-engaging member are positioned within the spacer frame such that the ends of the elongated members of the grid are below the sight line of the unit. The spacer-engaging member and the grid-engaging member can be a monolithic piece, or the grid-engaging member can be detachably secured to the platform of the spacer-engaging member.

11 Claims, 4 Drawing Sheets

U.S. PATENT DOCUMENTS 4,792,536 A 12/1988 Pecoraro et al.
4,806,220 A 2/1989 Finley
4,853,256 A 8/1989 Obringer et al.
4,873,206 A 10/1989 Jones
4,898,789 A 2/1990 Finley
4,989,384 A * 2/1991 Kinghorn et al. ..... 52/456
5,030,593 A 7/1991 Heithoff
5,099,626 A * 3/1992 Seeger ..... 52/314
5,105,591 A * 4/1992 Leopold ..... 52/172
5,155,952 A * 10/1992 Herwegh et al. ..... 52/100
5,177,916 A * 1/1993 Misera et al. ..... 52/172
5,240,886 A 8/1993 Gulotta et al.
5,313,761 A * 5/1994 Leopold ..... 52/786.1
5,343,662 A * 9/1994 Nelson ..... 52/208
5,424,111 A * 6/1995 Farbstein ..... 428/137
5,461,840 A * 10/1995 Taylor ..... 52/786.13
5,487,245 A * 1/1996 Dazo et al. ..... 52/204.61
5,501,013 A * 3/1996 Misera et al. ..... 29/897.312
5,531,047 A * 7/1996 Leopold et al. ..... 52/172
5,630,306 A * 5/1997 Wylie ..... 52/786.13
5,644,878 A * 7/1997 Wehrmann ..... 52/287.1
5,655,282 A 8/1997 Hodek et al.
5,657,590 A * 8/1997 Digman et al. ..... 52/204.61
5,678,376 A * 10/1997 Poma ..... 52/656.8
5,678,377 A * 10/1997 Leopold ..... 52/656.9
5,873,203 A 2/1999 Thiel
5,899,033 A * 5/1999 Merchlewitz ..... 52/204.61
6,027,766 A 2/2000 Greenberg et al.
6,115,989 A * 9/2000 Boone et al. ..... 52/786.13
6,219,982 B1 * 4/2001 Eyring ..... 52/396.04
D441,875 S * 5/2001 Wylie ..... D25/61
6,289,641 B1 * 9/2001 McCandless ..... 52/172
6,345,485 B1 * 2/2002 Boone et al. ..... 52/786.13
6,425,221 B1 * 7/2002 Reichert ..... 52/456
6,477,812 B2 * 11/2002 Boone et al. ..... 52/172
6,868,596 B2 * 3/2005 Reichert ..... 29/407.05
6,935,078 B1 * 8/2005 Benkel ..... 52/204.69
6,991,400 B1 * 1/2006 Negueloua ..... 404/56
7,082,650 B2 * 8/2006 Awakura et al. ..... 24/458
7,104,021 B2 * 9/2006 Apfelthaler ..... 52/656.9
7,124,546 B2 * 10/2006 Scharff et al. ..... 52/314
2001/0025404 A1 * 10/2001 Wright ..... 24/662
2001/0032436 A1 * 10/2001 Riegelman ..... 52/786.13
2001/0034990 A1 * 11/2001 Reichert ..... 52/456
2002/0046545 A1 * 4/2002 France ..... 52/786.1
2003/0084622 A1 * 5/2003 Hornung et al. ..... 52/172
2004/0123557 A1 * 7/2004 Hornung et al. ..... 52/786.13
2004/0154248 A1 * 8/2004 Reichert ..... 52/456
2004/0244158 A1 * 12/2004 Awakura et al. ..... 24/458
2005/0028458 A1 2/2005 Rosskamp et al.
2005/0071959 A1 * 4/2005 Minnich et al. ..... 24/297
2005/0235586 A1 * 10/2005 Hornung et al. ..... 52/204.61
2006/0026914 A1 * 2/2006 Schultz ..... 52/204.61
2006/0029463 A1 * 2/2006 Schultz et al. ..... 403/187
2006/0162281 A1 * 7/2006 Pettit et al. ..... 52/786.13
2006/0185294 A1 * 8/2006 Langer et al. ..... 52/456
2007/0193148 A1 * 8/2007 Simko et al. ..... 52/300
2007/0261795 A1 * 11/2007 Rosskamp et al. ..... 156/556
2008/0066411 A1 * 3/2008 Tyler ..... 52/456
2008/0172958 A1 * 7/2008 Tyler et al. ..... 52/204.62
2009/0056265 A1 * 3/2009 Davis, II ..... 52/456

OTHER PUBLICATIONS

U.S. Appl. No. 11/847,582, filed Aug. 30, 2007; Davis II.

* cited by examiner

RETAINER CLIP FOR GRID SIMULATING MUNTINS

BACKGROUND OF THE INVENTION

1. Field of the Invention

This invention relates to a clip for retaining a grid simulating muntins, and more particularly, to retainer clips for securing a grid simulating muntins within a spacer frame between adjacent sheets of a multi-sheet unit with the connection between the clips and the ends of the grid below the sight line of the unit.

2. Discussion of the Available Technology

Clips usually referred to as retainer clips or muntin clips are used to mount grids simulating muntins within a spacer frame between adjacent sheets of a multi-sheet insulating unit, e.g. as discussed in U.S. Pat. Nos. 5,313,761 and 6,115,989, and United States Patent Publication Numbers US2004/0123557 and US2005/0028458A1. In general, but not limiting to the discussion, a two sheet insulating unit includes a pair of glass sheets secured to sides of a closed spacer frame by a moisture and gas impervious adhesive-sealant to provide a sealed compartment between the sheets. The sealed compartment is usually filled with an insulating gas. The spacer frame in one embodiment of a multi-sheet insulating unit has a U-shaped cross section, e.g. as disclosed in U.S. Pat. No. 5,655,282. One of the features of a spacer frame having a U-shaped cross section is the movement of the upright legs of the spacer frame toward and away from one another in unison with the movement of the glass sheets as the insulating gas in the sealed compartment expands and contracts due to pressure changes acting on the outer surfaces of the sheets.

The current practices of mounting the grid simulating muntins within the spacer frame, includes mounting the retainer clips on the ends of the grid, and mounting the clips on the interior surface of the spacer frame, or mounting the retainer clips on the interior surface of the spacer frame followed by mounting the ends of the grid on the retainer clips. United States Patent Application Publication Number US 2004/0123557 discloses a number of retainer clip designs. Although the present design of the retainer clips is acceptable for mounting grids simulating muntins within the spacer frame of insulating glass units, there are limitations.

More particularly, many of the retainer clips have a rigid base that bridges the two upright legs of the spacer frame maintaining the upright legs in a fixed relationship to one another. The drawback with this retainer clip design is that the retainer clip prevents portions of the upright legs and marginal edges of the sheets from bending toward one another as the atmospheric pressure acting on the outside surface of the sheets increases. Another drawback with retainer clips having a rigid base is that during the pressing of the marginal edges of the sheets toward the outer surfaces of the space frame to flow the adhesive-sealant between the sheets and the spacer frame, the upright legs between adjacent retainer clips are flexible and bend or move toward one another whereas the retainer clip does not flex preventing the upright legs at the position of the retainer clip from moving toward one another. The undesirable result is the adhesive-sealant between adjacent retainer clips having a thickness greater than the thickness of the adhesive-sealant at the position of the retainer clips. This limitation results in a "moisture sealant path" or "diffusion path" having a non-uniform thickness and can result in premature failure of the seal by allowing atmospheric air to diffuse into the sealed compartment. For a discussion of the "diffusion path", reference can be made to column 13, lines 7-43 of U.S. Pat. No. 5,655,282 which patent is hereby incorporated by reference.

Another limitation with having the base of the retainer clip supported on and spanning the upright legs of the spacer frame is that the retainer clip is in the sight line of the insulating unit. Therefore, care has to be taken to make certain that the ends of the grid simulating muntins is flush with the base of the retainer clip to avoid any space, or minimize the space, between the ends of the grid and the base of the retainer clip. Noticeable separations between the base of the clip and the end of the grid are aesthetically unacceptable.

Still another limitation with the present retainer clip design is that the retainer clips because of their design have to be injection molded or machined which are expensive operations compared to pultrusion and extrusion.

As can now be appreciated by those skilled in the art, it would be advantages to provide retainer clips that do not have the limitation of the presently available retainer clips.

SUMMARY OF THE INVENTION

This invention relates to a clip for retaining a grid simulating muntins within a spacer frame. The clip includes, among other things, a spacer-engaging member having a platform, and first and second upright walls extending away from the platform with the walls spaced from one another. Each of the first and second upright walls have an inner surface and an outer surface, the outer surface having a groove. A grid-engaging member is mounted on the platform; the grid engaging member extending upward between the upright walls of the spacer-engaging member. The grid-engaging member has a first outer surface and an opposite second outer surface wherein the first outer surface of the grid-engaging member is spaced from and in facing relationship to the inner surface of the first upright wall, and the second outer surface of the grid-engaging member is spaced from and in facing relationship to the inner surface of the second upright wall.

Non-limiting embodiments of the invention include the spacer-engaging member and the grid-engaging member being a monolithic piece, and the grid-engaging member being detachably secured to the platform of the spacer-engaging member.

The invention further relates to a multi-sheet unit having, among other things, a pair of sheets; a spacer frame between the pair of sheets. The spacer frame includes, among other things, a base having an inner surface, a pair of spaced outer legs defined as a first outer leg and a second outer leg extending upward from the inner surface of the base and an extension connected to each of the legs and extending over the inner surface of the base toward one another. The inner surface of the base faces interior of the spacer frame and an adhesive secures marginal edges of the sheets to adjacent outer surface of the first and second outer legs of the spacer frame. A plurality of retaining clips are mounted on the extensions, and a grid simulating muntins has ends of the grid connected to the plurality of clips to position the grid between the pair of sheets.

In one non-limiting embodiment of the invention, at least one of the clips includes, among other things, a spacer-engaging member having a platform, and first and second upright walls extending away from the platform and spaced from one another. Each of the first and second upright walls have an inner surface, wherein the platform and a portion of the first and second upright walls are between the pair of spaced outer legs of the spacer frame, and a grid-engaging member is mounted on the platform and extends upward between the upright walls of the spacer-engaging member. The grid-engaging member has a first outer surface and an opposite second outer surface wherein the first outer surface of the grid-engaging member is spaced from the inner surface of the first outer wall, and the second outer surface of the grid-engaging member is spaced from the inner surface of the second upright wall. The grid simulating muntins is between the pair of sheets with ends of the grid connected to the plurality of clips, wherein the grid-engaging member of the at least one clip is in one end of the grid, and the one end of the grid is below sight line of the multi-sheet unit.

DESCRIPTION OF THE INVENTION

Figure 1:
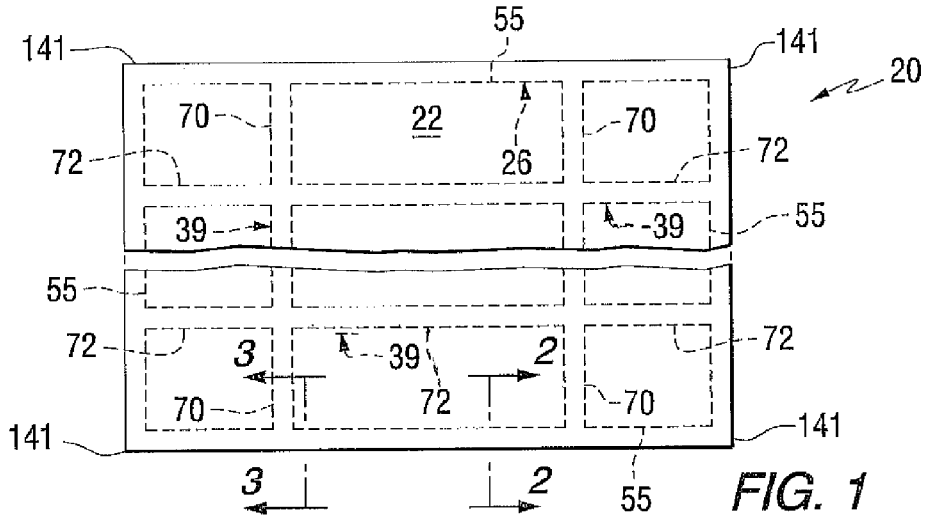
FIG. 1 is a plan view of a multi-sheet unit incorporating features of the invention.

As used herein, spatial or directional terms, such as "inner", "outer", "left", "right", "up", "down", "horizontal", "vertical", and the like, relate to the invention as it is shown in the drawing figures. However, it is to be understood that the invention can assume various alternative orientations and, accordingly, such terms are not to be considered as limiting. Further, all numbers expressing dimensions, physical characteristics, and so forth, used in the specification and claims are to be understood as being modified in all instances by the term "about." Accordingly, unless indicated to the contrary, the numerical values set forth in the following specification and claims can vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, e.g., 1 to 6.7, or 3.2 to 8.1, or 5.5 to 10. Also, as used herein, the terms "mounted over", "positioned over", or "provided over" mean mounted, positioned, or provided on but not necessarily in surface contact with. For example, one article "provided over" another article does not preclude the presence of materials between the articles.

Before discussing several non-limiting embodiments of the invention, it is understood that the invention is not limited in its application to the details of the particular non-limiting embodiments shown and discussed herein since the invention is capable of other embodiments. Further, the terminology used herein to discuss the invention is for the purpose of description and is not of limitation. Still further, unless indicated otherwise, in the following discussion like numbers refer to like elements.

In general, the non-limiting embodiments of the invention include, but are not limited to, retainer or muntin clips for mounting and/or securing grids simulating muntins between adjacent sheets of multi-sheet units. In general, the term "multi-sheet unit" is usually used to mean a unit having two or more sheets in spaced relationship to one another, and the term "multi-sheet insulating unit" is usually used to mean a unit having two or more sheets in spaced relationship to one another and a space or compartment between the sheets in which there is no or limited ingress or egress of gas into and/or out of the space, usually referred to as a "sealed compartment." In the following discussion, the term "multi-sheet unit", unless indicated otherwise, is used to mean a "multi-sheet unit" and a "multi-sheet insulating unit."

Figure 2:
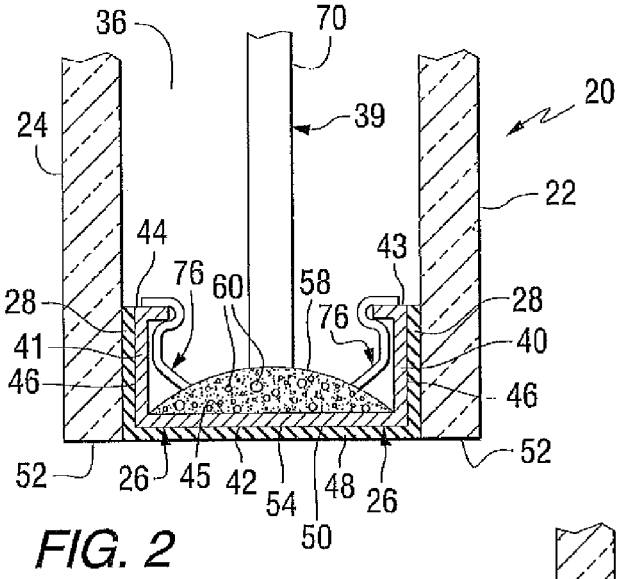
FIG. 2 is a view taken along lines 2-2 of FIG. 1.
Figure 3:
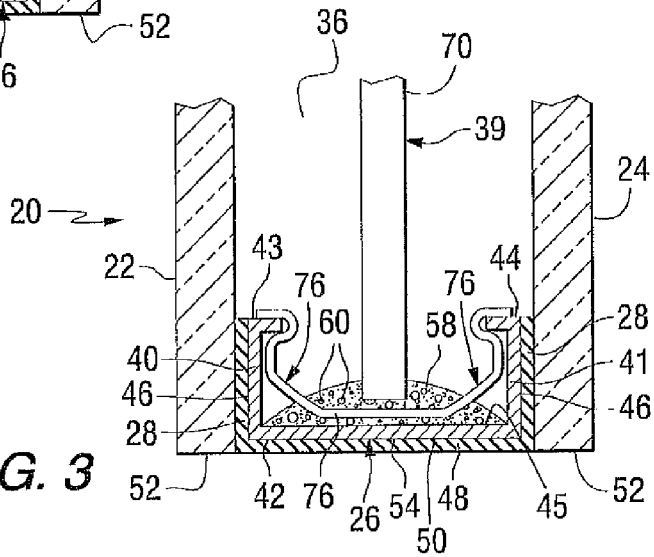
FIG. 3 is a view taken along lines 3-3 of FIG. 1.

FIG. 1 shows a multi-sheet unit 20 incorporating features of the invention, and FIGS. 2 and 3 show cross-sectional views of the multi-sheet unit 20. With specific reference to FIGS. 2 and 3, the unit 20 has a pair of outer sheets 22 and 24 secured to a spacer frame 26 by a layer 28 of an adhesive or moisture impervious adhesive-sealant to provide a compartment 36 between the sheets 22 and 24. Preferably, but not limiting to the invention, the compartment 36 is sealed against the egress and ingress of the atmosphere outside the compartment, e.g., gases, moisture and/or dust (hereinafter individually and collectively referred to as "environmental atmosphere") by the layers 28 of the adhesive sealant discussed in more detail below. A grid 39 simulating muntins, is provided in the compartment 36, i.e. within the spacer frame 26, between the sheets 22 and 24 in accordance to the teachings of the invention.

The invention is not limited to the material of the sheets 22 and 24 of the multi-sheet unit of the invention, and the sheets can be made of any transparent material, e.g. glass, plastic and combinations thereof, and the selection of the material of the sheets is not limiting to the invention. Still further, the two or more sheets of the multi-sheet unit can be made of the same material or the sheets can be made of different materials. In addition, one sheet can be a monolithic sheet, and the other sheet can be a laminate, e.g. a transparency made of one or more monolithic sheets laminated together in any usual manner. One or both of the glass sheets of the unit can be uncoated and/or coated, and/or one or both of the sheets can be colored and/or clear sheets. For example and not limiting to the invention, the colored sheets can be of the type disclosed in U.S. Pat. Nos. 4,873,206; 4,792,536; 5,030,593 and 5,240,886, which disclosures are hereby incorporated by reference. Further, one or more of the surfaces of one or more of the sheets can have a solar control coating to selectively pass predetermined wavelength ranges of light and energy, or one of the sheets can be opaque, e.g. made of an opaque material, e.g. metal, or providing an opaque coating of the type used to make spandrels over the surface of a transparent sheet, or one or more of the sheets can have a coatings of the type disclosed in U.S. Pat. Nos. 4,170,460; 4,239,816; 4,462,884; 4,610,711; 4,692,389; 4,719,127; 4,806,220; 4,853,256 and 4,898,789, which disclosures are hereby incorporated by reference. Still further, in the practice of the non-limiting embodiments of the invention, one or more of the surfaces of the sheets can have a photocatalytic film or water reducing film, e.g. of the type disclosed in U.S. Pat. Nos. 5,873,203; 6,027,766 and 6,027,766, which disclosures are hereby incorporated by reference. It is contemplated that the photocatalytic film and/or the water reducing film can be deposited on the outer surface of one or both sheets 22 and 24 of the multi-sheet unit 20.

The glass sheets 22 and 24 preferably have the same peripheral configuration and dimensions; however, as can be appreciated, one outer glass sheet can be larger than the other outer glass sheet. Further, the outer sheets 22 and 24 can have different peripheral configurations.

With continued reference to FIGS. 2 and 3, in the non-limiting embodiment of the invention under discussion, the spacer frame 26 has a pair of spaced outer legs 40 and 41 secured to a base 42 to have a generally U-shaped configuration. Each of the outer legs 40 and 41 have a ledge or extension 43 and 44, respectively, extending toward one another over inner surface 45 of the base 42. The layer 28 of adhesive is provided on outer surface 46 of the legs 40 and 41 of the spacer frame 26 to secure the outer sheets 22 and 24 to the legs 40 and 41, respectively, of the spacer frame 26 to seal the compartment 36 against movement of environmental atmosphere into and out of the compartment. The layer 28 is preferably a moisture-impervious adhesive-sealant of the type used in the art to seal compartments of insulating units, and includes, but is not limited to, butyls, silicones, polyurethane adhesives, and butyl hot melts of the type sold by PPG Industries, Inc. e.g. PRC591SB. For a more detailed discussion of materials that can be used in the practice of the invention, but not limited thereto, attention is directed to U.S. Pat. No. 5,655,282; U.S. Published Patent Application No. U.S. 2005/0028458A1, and U.S. patent application Ser. No. 11/696,377 filed Apr. 4, 2007 which disclosures are hereby incorporated by reference.

A layer 48 of an adhesive, sealant or adhesive-sealant can be provided on outer surface 50 of the base 42 of the spacer frame 26. Preferably the outer surface 50 of the base 42 is recessed inwardly from the peripheral edges 52 of the outer sheets 22 and 24 as viewed in FIGS. 2 and 3 to provide a channel 54 to receive the layer 48. The layer 48 can be a material similar or dissimilar to the material of the layers 28. As can be appreciated by those skilled in the art, the material of the layer 48 is preferably non-tacky after setting or drying so that the peripheral edges of the multi-sheet unit 20 do not stick to surfaces supporting the edge of the unit, especially during shipping and storage of the unit.

The spacer frame 26 can be made of any material e.g., wood, plastic, metal coated plastic, metal (e.g., stainless steel, galvanized steel or tin coated steel), aluminum and combinations thereof. Types of spacer frames and spacer stock that can be used in the practice of the invention, but not limited thereto, are disclosed in U.S. Pat. Nos. 5,177,916, and 5,655,282, and U.S. patent application Ser. No. 11/696,377 filed Apr. 4, 2007.

Figure 5:
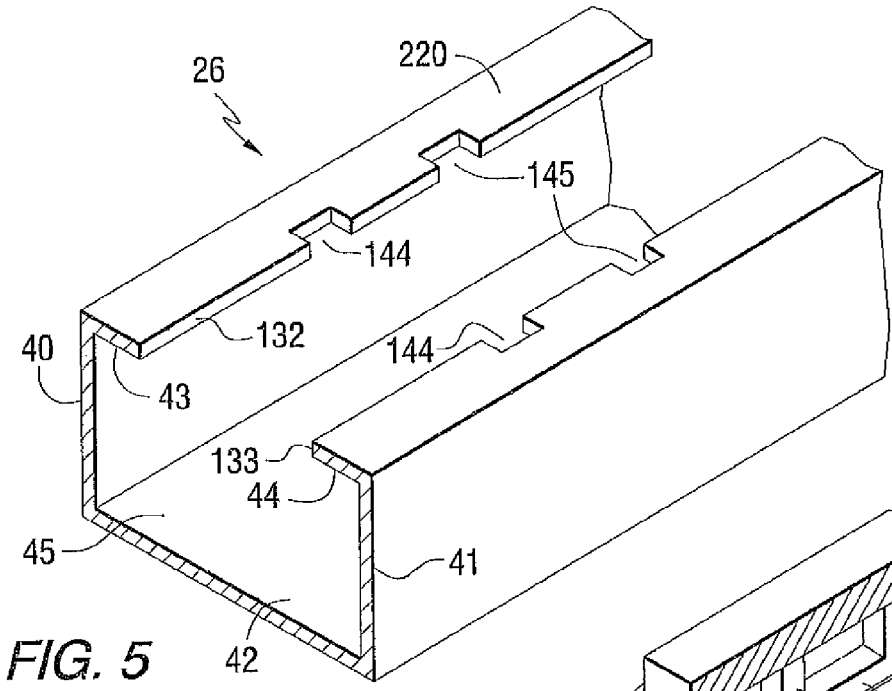
FIG. 5 is an orthogonal view of a section of a side of a spacer frame that can be used in the practice of the invention.
Figure 7:
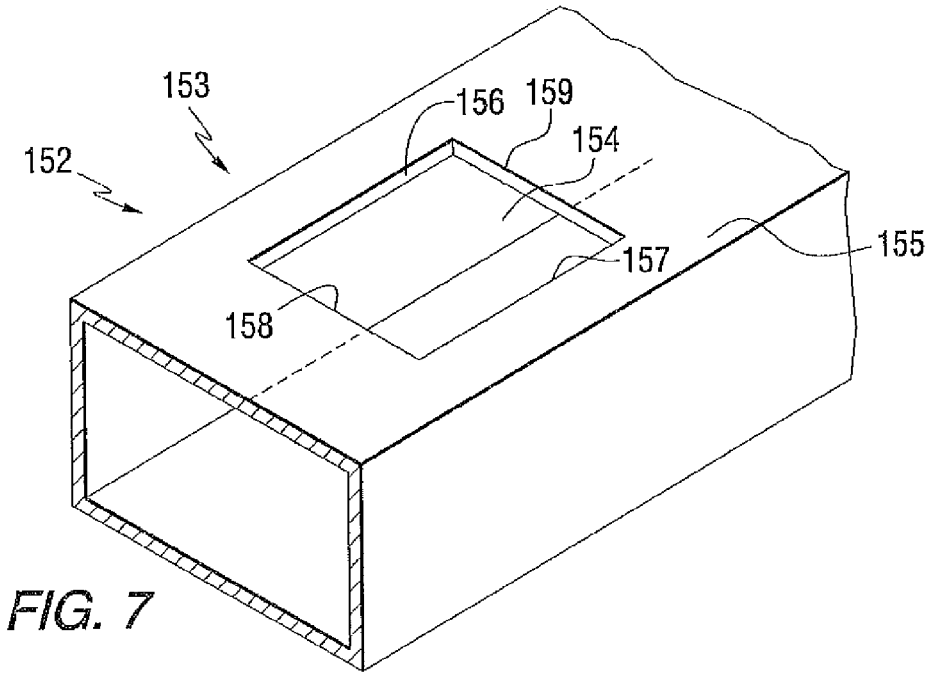
FIG. 7 is a view similar to the view of FIG. 5 showing another embodiment of a spacer frame that can be used in the practice of the invention.

Although the invention is not limited to the design or construction of the spacer frame 26, in a preferred non-limiting embodiment of the invention, the spacer frame is an endless or close ended ("closed") spacer frame having an interior opening as shown by dotted lines 55 in FIG. 1 and made from a continuous piece of spacer stock having a U-shaped cross-section as shown in FIGS. 2, 3 and 5. A detailed discussion of spacer stock having a U-shaped cross-section is presented in U.S. Pat. No. 5,177,916, the disclosure of which is hereby incorporated by reference. The invention further contemplates making a spacer frame from a continuous piece of spacer stock having a quadrilateral cross sectional shape as shown in FIG. 7. As can be appreciated, the invention is not limited to a spacer frame made from a continuous strip or piece of spacer stock, and the spacer frame can be made from spacer sections joined together by corner keys or welding, e.g., as disclosed in U.S. patent application Ser. No. 11/696,377 filed Apr. 4, 2007.

With continued reference to FIGS. 2 and 3, a bead 58 of a moisture-pervious adhesive material having a desiccant 60 therein, e.g. but not limiting to the invention, a desiccant impregnated polyurethane bead is on the inner surface 45 of the base 42 of the spacer frame 26 to adsorb moisture trapped in the sealed compartment 36 during fabrication of the unit 20. For a more detailed discussion of desiccant impregnated moisture-pervious adhesives, reference can be made to U.S. Pat. Nos. 5,177,916; 5,531,047 and 5,655,282, and U.S. Published Patent Application No. U.S. 2005/0028458A1, which disclosures are hereby incorporated by reference.

Referring now to FIG. 1, elongated vertical members 70 and elongated horizontal member 72 are joined together in any usual manner to form the grid 39 simulating muntins. The grid 39 is mounted or secured within the spacer frame 26, between the sheets 22 and 24, in the compartment 36, by retaining clips 76 of the invention (see FIGS. 2 and 3) in a manner discussed below. Fabricating grids simulating muntins is well known to those skilled in the art of fabricating multi-sheet glazing units, and the manner of fabricating the grid 39 is not limiting to the invention. A discussion of the particulars of forming a grid simulating muntins is well known in the art and is not presented herein.

Figure 4:
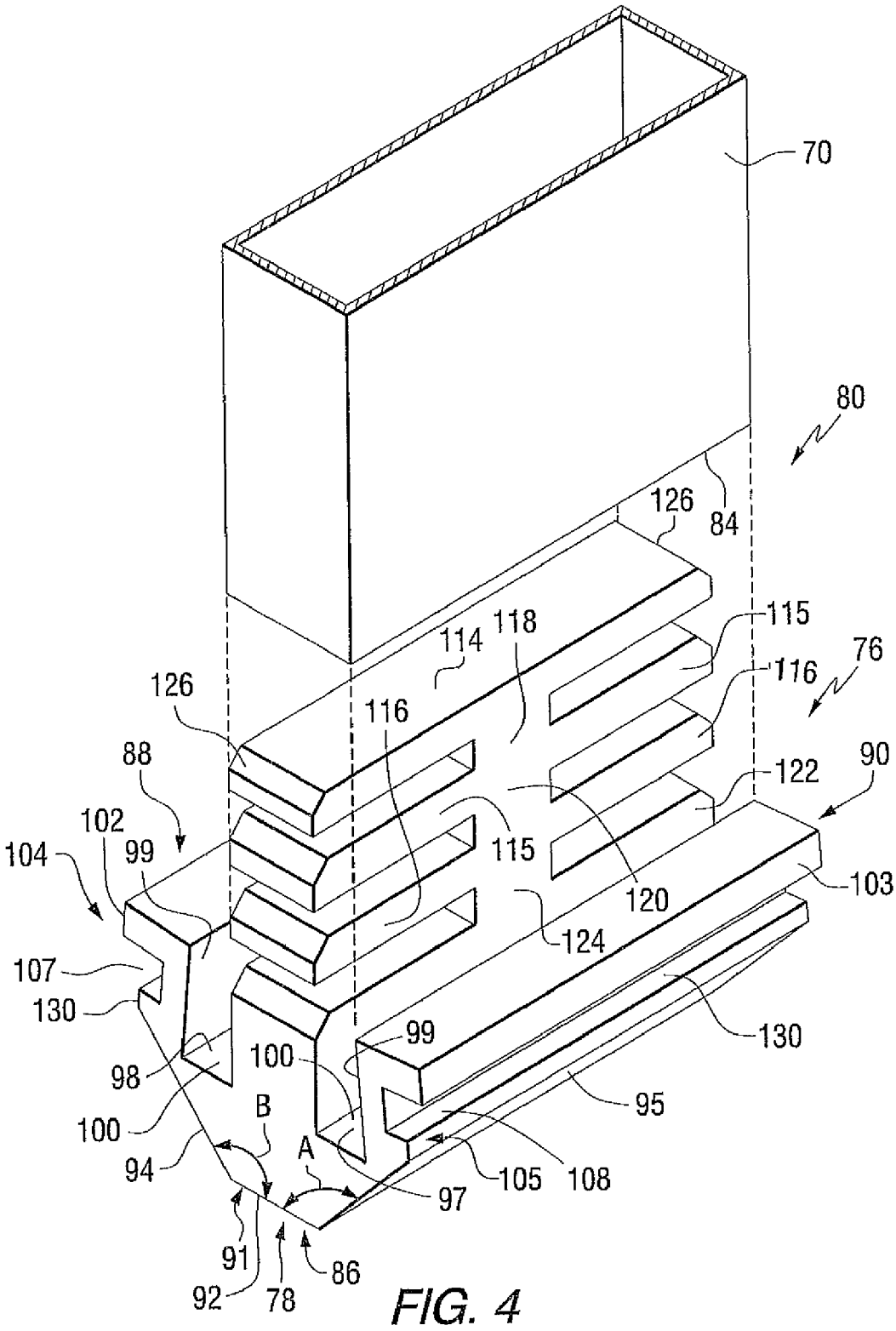
FIG. 4 is an orthogonal view of a non-limiting embodiment of a retainer clip of the invention spaced from an end of an elongated member of a grid simulating muntins, the grid shown in FIG. 1.

With reference to FIG. 4, the muntin clip 76 of the invention includes a spacer-engaging segment or member 78 that is positioned between, and secured to, the ledges 43 and 44 of the outer legs 40 and 41, respectively, of the spacer frame 26 in a manner discussed below, and a grid-engaging segment or member 80 that is inserted into open ends 84 of the vertical and horizontal members 70 and 72, respectively of the grid 39. In FIG. 4, only the open end 84 of one of the elongated vertical members 70 of the grid 39 is shown. The spacer-engaging segment 78 of the muntin clip 76 includes a platform 86 joined to a first upright wall 88 and to an opposite second upright wall 90 spaced from the first upright wall 88 giving the spacer-engaging segment 78 a generally U-shaped cross section. Outer surface 91 of the platform 86 of the spacer-engaging segment 78 has a flat base surface portion 92 and outer wall surface portions 94 and 95 extending away from the flat base surface portion 92. The flat base surface portion 92 and the outer wall surface portion 95 subtend an obtuse angle A, and the flat base surface portion 92 and the outer wall surface portion 94 subtend an obtuse angle B. The slope of the outer wall surface portions 94 and 95 facilitates moving the spacer-engaging segment 78 between the ledges 43 and 44 of the outer legs 40 and 41, respectively, of the spacer frame 26 (see FIGS. 2 and 3). As can be appreciated, the invention is not limited to the size of the obtuse angles A and/or B. Further the obtuse angles A and B can be equal to, or different from, one another. In one non-limiting embodiment of the invention, the angles A and B are each in the range of greater than 90 degrees and less than 150 degrees, e.g. 135 degrees.

The grid-engaging segment 80 extends upward from the platform 86 of the spacer-engaging segment 78 between and spaced from the first and second upright walls 88 and 90, respectively, of the spacer-engaging segment 78 to provide a first groove 97 on one side, and a second groove 98 on the other side, of the grid-engaging segment 80 to receive one of the ends 84 of the vertical or horizontal members 70 or 72, respectively, of the grid 39, e.g. the end 84 of one of the vertical members 70 as shown in FIG. 4.

In one non-limiting embodiment of the invention, inner surface 99 of the upright walls 88 and 90 are generally normal to inner base surface 100 of first and second grooves 97 and 98, respectively, of the platform 86 of the spacer-engaging segment 78, and the outer wall surface portions 94 and 95 extend beyond the inner base surface 100 of the grooves 97 and 98. With this arrangement, a thinning of the wall thickness at the juncture of the inner base surface 100 of the platform 86 and the inner surface 99 of the upright walls 88 and 90, respectively, of the spacer-engaging segment 78 is realized. The thinning of the wall thickness reduces the force require to move the muntin clips 76 between the ledges 43 and 44 of the outer legs 40 and 41, respectively, of the spacer frame 26 (see FIGS. 2 and 3) and provides for ease of flexing or bending the first and second upright walls 88 and 90 of the spacer-engaging segment 78 of the muntin clip 76 toward and away from one another as the sheets 22 and 24 move toward and away from one another due to pressure changes acting on the sheets as discussed above.

Outer surface 102 of the first upright wall 88, and outer surface 103 of the second upright wall 90 includes a ledge-engaging segment 104 and 105, respectively connected to the outer wall surface portions 94 and 95, respectively of the platform 86 of the spacer-engaging segment 78. The ledge-engaging segment 104 of the first upright wall 88 has a groove 107, and the ledge-engaging segment 105 of the second upright wall 90 has a groove 108. The grooves 107 and 108 are sized to receive end portions 132 and 133 of the ledge or extension 43 of the first outer leg 40, and the ledge or extension 44 of the second outer leg 41, respective (see FIG. 5) as discussed below.

In one non-limiting embodiment of the invention, the grid-engaging segment 80 is of the type commonly referred to in the trade as a "Christmas tree," and in this embodiment of the invention, includes a plurality of flexible extensions 114, 115 and 116 with the extensions 114 and 115 spaced from one another, and interconnected, by shim 118; the extensions 115 and 116 spaced from one another, and interconnected, by shim 120, and extension 116 and raised elongated extension 122 spaced from one another, and interconnected by shim 124. Preferably but not limiting to the invention, the raised elongated extension 122 is secured to the platform 86 of the spacer-engaging segment 78 to prevent the elongated horizontal and vertical members 70 and 72, respectively, of the grid 39 from rotating relative to the platform 86 of spacer-engaging segment of the muntin clip 76.

As can be appreciated the invention is not limited to the design of the grid-engaging member 80 and any of the designs used in the art can be used in the practice of the invention.

In one non-limiting embodiment of the invention, the flexible extension 114 farthest from the platform 86 of the muntin clip 76 is shorter than the flexible extension 115, which is shorter than the flexible extension 116 which is shorter than the raised elongated extension 122 which, preferably, but not limited to the invention is sized to be pressure fitted into one of the ends 84 of one of the elongated vertical or horizontal members 70 and 72, respectively, of the grid 39. The ends 126 of the extensions 114, 115, 116 and 122 are sloped (only ends of the extension 114 are numbered in FIG. 4 for purposes of clarity, and only numbered in FIG. 4) for ease of moving the ends 84 of the elongated vertical and horizontal members of the grid 39 over the grid-engaging segment 80 of the muntin clip 76.

As can be appreciated, the flexible extensions 114, 115 and 116; the shims 118, 120 124, and the raised elongated extension 122 of the grid-engaging member 80, and the spacer-engaging segment 78, of the muntin clip 76 can be one made as one piece, e.g. pressed or injection molded, or machined, or made as a plurality of pieces joined together. Further the muntin clip 76 can have any number of elongated members. Still further the muntin clip can be made of any material, e.g. but not limited to wood, metal, plastic or fiber re-enforced plastic. In one non-limiting embodiment of the invention, the muntin clip is a one-piece injection molded polypropylene muntin clip.

The retainer or muntin clips of the invention can be inserted between the outer legs 40 and 41 of the spacer frame 26 in any convenient manner. With reference to FIGS. 3 and 4 as needed, in one non-limiting embodiment of the invention, after the spacer frame 26 is formed, the bead 58 having the desiccant 60 is applied to the inner surface 45 of the base 42 of the spacer frame 26. The platform 86 of the spacer-engaging segment 78 of the muntin clip 76 is moved between the ledges or extensions 43 and 44 of the outer legs 40 and 41 of the spacer frame 26 to move the outer wall surface portions 94 and 95 of the platform 86 into engagement with the end portions 132 and 133 the ledges 43 and 44, respectively. Continued movement of the muntin clip 76 toward the base 42 of the spacer frame 26 moves wall 130 of the grooves 107 and 108 of the first and second upright walls 88 and 90, respectively, of the spacer-engaging segment 80 against the end portions 132 and 133 of the ledges 43 and 44, respectively to move the outer legs 40 and 41 of the spacer frame 26 away from one anther and/or the first and second upright walls 88 and 90, respectively of the spacer-engaging segment 78 toward one another. The wall 130 of the grooves 107 and 108 of the upright walls 88 and 90, respectively moves between and past the end portions 132 and 133 of the ledges 43 and 44, respectively to move the end portions 132 and 133 of the ledges 43 and 44 into the grooves 107 and 108, respectively of the spacer-engaging segment 78.

With the ledges 43 and 44 in the grooves 107 and 108 respectively, the muntin clip 76 is mounted between the legs 40 and 41 of the spacer frame 26 and prevented from moving toward and away from the base 42 of the spacer frame 26. The elongated vertical and horizontal members 70 and 72 of the grid 39 are joined together in any usual manner, and the ends 84 of the elongated vertical and horizontal members 70 and 72, respectively of the grid 39 are mounted on the grid-engaging segment 80 of the muntin clips 76. The elongated vertical and horizontal members 70 and 72 of the grid 39 are hollow and flexible and are easily flexed to pass the ends 84 of the members over the extensions 114, 116 and 122 of the grid-engaging segment 80 of the muntin clips 76. In another non-limiting embodiment of the invention, the elongated vertical and horizontal members 70 and 72 of the grid 39 are joined together in any convenient manner to form the grid 39, and the grid-engaging segments 80 of the muntin clips 76 are inserted into the ends 84 of the elongated vertical and horizontal members 70 and 72, respectively of the grid 39. Thereafter, the muntin clips 76 are mounted on the spacer frame as discussed above to mount the grid 39 within the spacer frame 26.

As is appreciated by those skilled in the art, the grid 39, the outer legs 40 and 41 of the spacer frame 26, and the sides of the spacer frame are flexible so that the grid 39 can be mounted within the closed ended spacer frame as discussed above; however, in those instances when the grid 39 and the spacer frame 26 do not provide sufficient flexibility, a corner of the spacer frame 26 can be left open, and after the grid is mounted within the spacer frame, the open end of the spacer frame is closed.

As mentioned above, the ledges 43 and 44 of the spacer frame 26 in the grooves 107 and 108, respectively, prevent the muntin clip 76 from moving toward and away from the base 42 of the spacer frame 26. Movement of the muntin clip 76 along the ledges 43 and 44 between adjacent ones of corners 141 of the spacer frame 26 (see FIG. 1) can be prevent by the interlocked elongated vertical and horizontal members 70 and 72 of the grid 39; by providing a pressure fit between the extensions 43 and 44, and the grooves 107 and 108 of the muntin clips 76; by an adhesive, e.g. the outer surface 91 of the platform 86 of the spacer-engaging segment 78 of the muntin clips 76 contacting the adhesive bead 58 (see FIGS. 2 and 3), and/or by providing one or more tabs in the grooves 107 and 108 of the muntin clip 76 that engage one or more cut outs in the ledges 43 and 44 of the spacer frame 26, to name a few techniques to secure the muntin clip in position on the spacer frame. In a preferred non-limiting embodiment of the invention, the tab and cut out arrangement is used.

Figure 6:
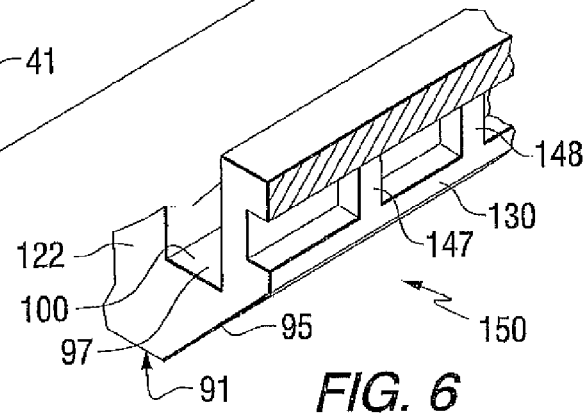
FIG. 6 is a fragmented view of a side of a non-limited embodiment of a retainer clip of the invention.

With reference to FIG. 5, the extensions 43 and 44 each have a pair of spaced cut outs 144 and 145 to receive spaced tabs 147 and 148, respectively, in the grooves 107 and 108, of muntin clip 150 shown in FIG. 6. As can be appreciated, FIG. 6 shows a segment of the muntin clip 150. The muntin clip 150 is similar to the muntin clip 76 shown in FIG. 4. The difference between the muntin clip 150 and the muntin clip 76 is that the muntin clip 150 has the tabs 147 and 148 in the grooves 107 and 108 (only tabs 147 and 148 of the groove 108 shown, and only shown in FIG. 6) whereas the muntin clip 76 shown in FIG. 4 does not have any tabs in the grooves 107 and 108. In one non-limiting embodiment of the invention, the muntin clips 150 are mounted between the ledges 43 and 44 of the spacer frame 26 in a similar manner as discussed above to mount the muntin clips 76 between the ledges 43 and 44 with the addition that the tabs 147 and 148 of the muntin clip 150 move into their respective one of the cut outs 144 and 145 in the ledges 43 and 44, respectively.

As is appreciated, the invention is not limited to the cross sectional shape of the spacer frame. For example and not limiting to the invention, the cross section of the spacer frame can have a generally U-shaped cross section as shown for the spacer frame 26 in FIG. 5, or the cross section of the spacer frame can have a quadrilateral or box shaped cross section as shown in FIG. 7 for segment 152 of a spacer frame 153. A hole 154 is cut in side 155 of the spacer frame 153 facing the interior of the closed spacer frame to receive the muntin clip 76 (see FIG. 4). With the spacer-engaging segment 78 (see FIG. 4) of the muntin clip 76 in the hole 154 of the spacer frame 153, sides 156 and 157 of the hole 154 are in the grooves 107 and 108, respectively of the muntin clip 76. The sides 158 and 159 of the hole 154 prevent the muntin clip 76 from moving between adjacent corners 141 of the closed spacer frame.

As can now be appreciated, with the muntin clips 76 mounted between the outer legs 40 and 41 of the spacer frame 26, and the end 84 of the elongated members 70 and 72 between the upright walls 88 and 90 of the spacer-engaging segment 78 of the muntin clip 76, e.g. the end 84 over the raised elongated extension 122 (see FIG. 4) of the grid-engaging segment 80, the ends 84 of the vertical and horizontal members of the grid 39 are below the sight line 55 of the unit 20. The "sight line" is the line 55 shown in FIG. 1 which defines the interior of the spacer frame, and "below the sight line" is a position between the outer legs 40 and 41 of the spacer frame 26. More particularly, the platform 86 of the muntin clip of the invention is below the extensions 43, 44 of the spacer frame 26, and the platform 86 is below the sight line of the multi-sheet unit 20 (see also FIGS. 2 and 3). With this arrangement any defects such as ends 84 of the elongated vertical and horizontal members 70 and 72, respectively, having jagged edges and/or spaced a noticeable distance from the inner base surface 100 of the platform 86 of the muntin clip are hidden from the vision of the person looking through the unit 20.

Figure 8:
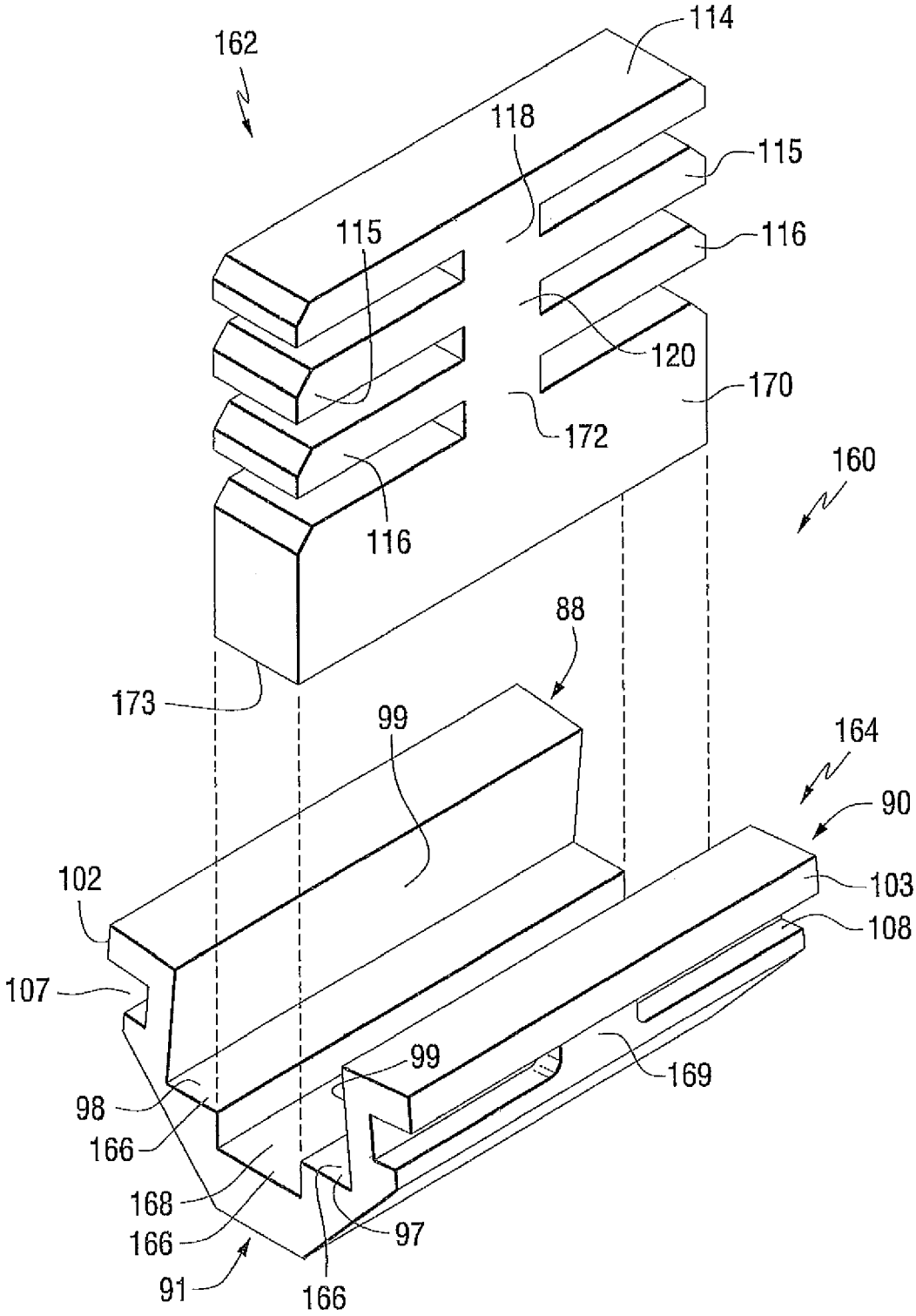
FIG. 8 is an orthogonal view of a non-limiting embodiment of a two-part retainer clip of the invention.

Shown in FIG. 8, is another non-limiting embodiment of a retainer or muntin clip of the invention designated by the number 160. The muntin clip 160 includes grid-engaging member or segment 162 and spacer-engaging member or segment 164. The spacer-engaging member 164 is similar to the spacer-engaging member 78 of the muntin clip 76 shown in FIG. 4, except that muntin clip 160 is a two piece muntin clip having inner surface 166 of the spacer-engaging member 164 having a groove or slot 168 to receive and retain the grid-engaging member 162 in a manner discussed below, and the spacer-engaging member 164 has a tab 169 in the grooves 107 and 108.

The grid-engaging member 162 includes the flexible extensions 114, 115 and 116 separated by the shims 118 and 120, and further includes insert member 170 separated from, and joined to flexible extension 116 by shim 172. The insert member 170 and the groove 168 of the spacer-engaging member 164 are sized to provide a pressure fit so that the insert member 170 of the grid-engaging member 162 is retained in the groove 168. Optionally, the edges of bottom surface 173 of the insert member 170 can be rounded for ease of initiating the insertion of the insert member 170 into the groove 168. With the insert member 170 in the groove 168, the grid-engaging member 162 is spaced from the inner surface 99 of the first upright wall 88 and the second upright wall 90 of the spacer-engaging member 164 to provide the grooves 97 and 98 (see also FIG. 4). In this manner the ends 84 of the vertical and horizontal members 70 and 72, respectively of the grid 39 are below the sight line.

As can be appreciated, the invention is not limited to the manner in which the insert member 170 of the grid-engaging member 162 is retained on or in the inner surface 166 of the base 164 of the muntin clip 160. For example, but not limited to the invention, the insert member 170 can be retained or secured in the groove 168 by an adhesive, by a pressure or friction fit, by interlocking members, e.g. but not limited to tabs and holes, or by mechanical members such as, but not limited to screws and nails. Further, the invention contemplates the spacer-engaging member 164 of the muntin clip 160 having a flat surface, i.e. without the groove 168, and the grid-engaging member 162 secured on the flat inner surface of the base. Further, the invention contemplates the grid-engaging member 162 be a single formed or machined piece, or a single piece having the flexible members and shims joined together in any convenient manner. Still further, the length of the insert member 170 and the length of the groove 168 are not limiting to the invention and the length of the insert member 170 can be greater than, equal to, or less than, the length of the base 164 of the muntin clip 160. In the preferred non-limiting embodiment of the invention, the length of the insert member is less than the length of the base 164 of the muntin clip 160. In this manner, one size spacer-engaging member 164 can be used with several sizes of the grid-engaging member 162 without the insert member 170 of the grid-engaging member 162 overhanging the sides of the spacer-engaging member 164 of the muntin clip 160.

Another feature of the retainer or muntin clip 160 is that the spacer-engaging member 164 and the grid-engaging member 162 can each be pultruded, extruded or injection molded, whereas the retainer or muntin clip 76 shown in FIG. 4 can be injection molded, but can not be, or can not easily be, pultruded or extruded because of it complex shape.

Although in the preferred practice of the invention, the spacer-engaging member 164 and the grid-engaging member 162 of the muntin clip 160 are joined together before mounting the muntin clip 160 in the spacer frame 26, or on the end 84 of the grid 39, the invention is not limited thereto. More particularly, in another non-limiting embodiment of the invention, the insert member 170 of the grid-engaging member 162 can be positioned in the groove 168 of the spacer-engaging member 164 before or after the base 164 of the muntin clip 160 is mounted between the extensions 43 and 44 of the spacer frame 26, 142 or 153 (see FIGS. 2, 3, 5 and 7).

The invention is not limited to the number of cut outs in the ledges 43 and 44 of the spacer frame 26, or the number of tabs in the grooves 107 and 108 of the muntin clip. For example, and not limiting to the invention, the muntin clip can have no tabs in the grooves 107 and 108 as shown for the muntin clip 76 in FIG. 4; can have one tab, e.g. the tab 169 shown in FIG. 8 for the muntin clip 160; can have two tabs 147 and 148 as shown for the muntin clip 150 in FIG. 6, or more than 2 tabs. Further, the invention contemplates having tabs extending from the ledges 43 and 44, and the grooves of the upright walls of the muntin clip having cutouts to receive the tabs of the ledges.

Further, the invention contemplates the grid-engaging member 76, e.g., one or more of the members 114, 115 and/or 116, extending above the outer walls 88 and 90 (see FIG. 4) or below the outer walls.

As can be appreciated, the invention is not limited to the embodiments of the retainer or muntin clips discussed above, and the scope of the invention is only limited by the scope of the following claims.

What is claimed is:

1. A multi-sheet unit comprising:

a pair of sheets;

a spacer frame between the pair of sheets, the spacer frame comprising a base having an inner surface, first outer leg and a spaced second outer leg, each outer leg extending upward from the inner surface of the base and a first extension connected to the first outer leg and a second extension connected to the second outer leg, the first and the second extensions extending over the inner surface of the base toward one another, wherein the inner surface of the base faces the space between the first outer leg and the second outer leg, and faces interior of the spacer frame, and wherein the first extension and the second extension each have an inner surface and an opposite outer surface with the inner surface of the first extension and the second extension facing the inner surface of the base;

an adhesive securing marginal edges of the sheets to adjacent outer surfaces of the first and second outer legs of the spacer frame;

a plurality of clips for retaining a grid simulating muntins mounted on the extensions, at least one of the clips comprising:

a spacer-engaging member having a platform, and first and second upright walls connected to and extending away from the platform and spaced from one another, each of the first and second upright walls having an inner surface, an opposite outer surface, a first end and an opposite second end, wherein the outer surface of the first upright wall has a first groove and the outer surface of the second upright wall has a second groove, the first and the second grooves each having an unobstructed channel and the groove and its respective channel of the first and the second upright walls extending continuously from the first end to the second end of its respective outer wall, wherein the first groove and the second groove each have a first inner channel surface and an opposite second inner channel surface, the first and the second inner channel surfaces of the first groove face one another and extend continuously from the first end to the second end of the first upright wall, and wherein an end portion of the first extension of the first leg is in the channel of the first groove of the first upright wall and the first channel surface of the first groove overlays the outer surface of the first extension and the second channel surface of the first groove is in facing relationship to the inner surface of the first extension, and wherein the first and the second inner channel surfaces of the second groove face one another and extend continuously from the first end to the second end of the second upright wall, and an end portion of the second extension of the second leg is in the channel of the second groove of the second upright wall and the first channel surface of the second groove overlays the outer surface of the second extension and the second channel surface of the second groove is in facing relationship to the inner surface of the second extension, to position the platform and a portion of the first and second upright walls of the spacer-engaging member between the pair of spaced outer legs of the spacer frame, and a grid-engaging member mounted on the platform of the at least one clip and extending upward between the upright walls of the spacer-engaging member, the grid-engaging member having a first outer surface and an opposite second outer surface wherein the first outer surface of the grid-engaging member is spaced from the inner surface of the first outer wall and the second outer surface of the grid-engaging member is spaced from the inner surface of the second upright wall, and a grid simulating muntins between the pair of sheets with ends of the grid connected to the plurality of clips, wherein the grid-engaging member of the at least one muntin clip is in one end of the grid and the one end of the grid is between the inner surface of the base and the inner surface of the first extension and the second extension of the spacer frame of the multi-sheet unit.

2. The multi-sheet unit according to claim 1 wherein the spacer frame is a closed spacer frame, the adhesive is a moisture and gas impervious adhesive-sealant and the sheets are glass sheets, and further comprising a moisture and gas pervious adhesive having a desiccant mixed therein on the inner surface of the base of the spacer frame.

3. The multi-sheet unit according to claim 1 wherein portions of the extensions of the first and second outer legs between adjacent clips extend over the base of the spacer frame to provide the spacer frame with a quadrilateral cross section.

4. The multi-sheet unit according to claim 1 wherein the extensions of the first and second outer legs are spaced from one another to provide the spacer frame between adjacent clips with a generally U-shaped cross section.

5. The multi-sheet unit according to claim 1 wherein an outer surface of the platform of the spacer-engaging member of the at least one clip has an outer support base surface, wherein one side of the outer support base surface is connected to the outer surface of the first upright wall and a second side of the outer support base surface is connected to the outer surface of the second upright wall, wherein the connection of outer support base surface and the outer surface of the first outer wall subtend a first obtuse angle and the outer support base surface and the second surface of the second upright wall subtend a second obtuse angle.

6. The multi-sheet unit according to claim 1 wherein the inner surface of the first upright wall is spaced from, and out of contact with, the first outer surface of the grid-engaging member, and the inner surface of the second upright wall is spaced from, and out of contact with, the second outer surface of the grid-engaging member, wherein the first and second walls of the at least one clip and the spaced outer legs of the spacer frame adjacent the at least one clip are free to move toward one another and the grid-engaging member of the at least one clip, and wherein portions of the grid-engaging member extend above the upright walls.

7. The multi-sheet unit according to claim 6 wherein the first outer wall of the grid-engaging member and the inner surface of the first wall of the at least one clip are each connected to a first inner surface of the platform of the spacer-engaging member of the at least one clip; the second outer wall of the grid-engaging member and the inner surface of the second wall are each connected to a second inner surface of the platform of the spacer-engaging member, and the platform of the spacer-engaging member has an outer base surface, a first outer wall surface on one side of the base surface, the first outer wall surface extending away from the base surface, wherein the outer base surface and the first outer wall surface subtend a first obtuse angle, and a second outer wall surface on other side of the outer base surface, the second outer wall surface extending away from the base surface, wherein the outer base surface and the second outer wall surface subtend a second obtuse angle.

8. The multi-sheet unit according to claim 1 wherein the spacer-engaging member and the grid-engaging member of the at least one clip are a monolithic piece.

9. The multi-sheet unit according to claim 1 wherein the grid-engaging member of the at least one clip is detachably secured to the platform of the spacer-engaging member of the at least one clip.

10. The multi-sheet unit according to claim 9 wherein the space between the first and second upright walls is a space between the inner surfaces of the first and second upright walls and the platform of the spacer-engaging member of the at least one clip has a groove in a surface of the platform between and facing the space between the inner surfaces of the first and second upright walls and the grid-engaging member of the at least one clip has an end, wherein the end of the grid-engaging member is in the groove of the platform of the spacer-engaging member.

11. The multi-sheet unit according to claim 1 wherein the first inner channel surface and the second inner channel surface of the first groove have the same length, and the first inner channel surface and the second inner channel surface of the second groove have the same length, wherein the length of the first inner channel surface and the second inner channel surface of the first groove is the distance between the first end and the second end of the first outer wall, and the length of the first inner channel surface and the second inner channel surface of the second groove is the distance between the first end and the second end of the second outer wall.

* * * * *